US006857442B1

(12) United States Patent
Ball et al.

(10) Patent No.: US 6,857,442 B1
(45) Date of Patent: Feb. 22, 2005

(54) FREEZE PROTECTION DEVICE FOR WALL HYDRANTS/FAUCETS

(75) Inventors: William T. Ball, Colorado Springs, CO (US); Cody W. Jackson, Colorado Springs, CO (US); Lawrence Almasy, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 10/674,740

(22) Filed: Sep. 30, 2003

(51) Int. Cl.[7] ..... F16K 31/64; E03B 7/08; E03B 7/12; F16L 55/07

(52) U.S. Cl. ..... 137/60; 137/61; 137/62; 137/301; 137/360; 137/533.11; 137/614.18; 137/614.2; 138/32

(58) Field of Search ..... 137/59, 60, 61, 137/62, 218, 272, 282, 301, 302, 539, 601.2, 614.18, 614.2, 614.21, 78.1, 79, 107, 360, 533.11; 138/27, 32

(56) References Cited

U.S. PATENT DOCUMENTS

| | | | | |
|---|---|---|---|---|
| 3,913,602 A | * | 10/1975 | Yoon | 137/60 |
| 4,182,356 A | * | 1/1980 | Woodford, Sr. | 137/59 |
| 5,392,805 A | * | 2/1995 | Chrysler | 137/360 |
| 5,740,831 A | * | 4/1998 | DeNardo et al. | 137/218 |
| 6,142,172 A | * | 11/2000 | Shuler et al. | 137/59 |
| 6,532,986 B1 | * | 3/2003 | Dickey et al. | 137/360 |

* cited by examiner

*Primary Examiner*—George L. Walton

(57) ABSTRACT

A freezeless wall hydrant has a normally horizontal fluid inlet tube with an interior end and exterior end. A hollow valve fitting is rigidly secured to the interior end of the inlet tube for a connection to a source of pressurized fluid. A movable ball is located with a fluid conduit that extends from the interior of the inlet tube to the location of the potable water source. When the water pressure inside the inlet tube increases because of the presence of ice, the high pressure of such water moves the ball to open fluid flow of the high pressure fluid to the source of potable water which will be at a lower pressure, thus reducing the fluid pressure within the inlet tube and saving it from rupture.

3 Claims, 3 Drawing Sheets

FREEZE PROTECTION DEVICE FOR WALL HYDRANTS/FAUCETS

BACKGROUND OF THE INVENTION

Freezeless wall hydrants and faucets have long been in existence. They characteristically have a fluid closure valve located in the end of an inlet pipe located within the wall or a warmer interior area of the building of which the wall is a part. This closure valve is operated by an elongated rod connected to an exterior handle. The freezeless characteristics of the hydrant are caused by the closure valve shutting off the flow of water within the wall or building at a freezing temperature, with the residual water in the inlet pipe flowing by gravity outwardly through the conventional outlet drain of the hydrant.

The foregoing structure works very successfully except in situations where a hose or the like is attached to the outlet drain of the hydrant, whereupon the residual water is not able to easily flow by gravity out of the hydrant when the closure valve connected to the pressurized water is closed. With a hose attached during freezing weather, the residual water freezes within the hydrant, and the inlet pipe or related components thereupon rupture from the freezing conditions within the hydrant.

It has in recent times been recognized that the rupture of such a hydrant under freezing weather conditions does not take place because of the frozen water in the hydrant. Rather, the rupture results from the ice imposing severe pressure on the captivated non-frozen fluid in the inlet pipe. Thus, the increased pressure on this water by the expanded ice is the principal cause for the rupture of the hydrant.

Accordingly, it is a principal object of this invention to provide a freezeless wall hydrant which has the ability to relieve the pressure on the residual water located inwardly of frozen residual water located outwardly thereof when that water freezes by reason of a hose or the like being attached to the discharge nozzle.

These and other objects will be apparent to those skilled in the art.

SUMMARY OF THE INVENTION

A freezeless wall hydrant has a normally horizontal fluid inlet tube with an interior end and exterior end. A hollow valve fitting is rigidly secured to the interior end of the inlet tube for a connection to a source of pressurized fluid. A valve seat is located on an interior end of the valve fitting.

A casting member is rigidly secured to the outer end of the inlet tube and includes a drain conduit in communication with an interior of the inlet tube for discharging water from the hydrant. A valve body is longitudinally movably mounted in the inlet tube adjacent to the valve fitting. A valve seating element is on the valve body and is adapted to engage and disengage the valve seat to prevent or to permit, respectively, a fluid flow through the valve fitting into the inlet tube.

An elongated operating rod has a rearward end secured to the valve body and an outer end protruding from the casting member for longitudinally moving the valve body in the inlet tube.

A movable ball is located with a fluid conduit that extends from the interior of the inlet tube to the location of the potable water source. When the water pressure inside the inlet tube increases because of the presence of ice, the high pressure of such water moves the ball to open fluid flow of the high pressure fluid to the source of potable water which will be at a lower pressure, thus reducing the fluid pressure within the inlet tube and saving it from rupture.

DESCRIPTION OF THE PREFERRED EMBODIMENT

Figure 1:
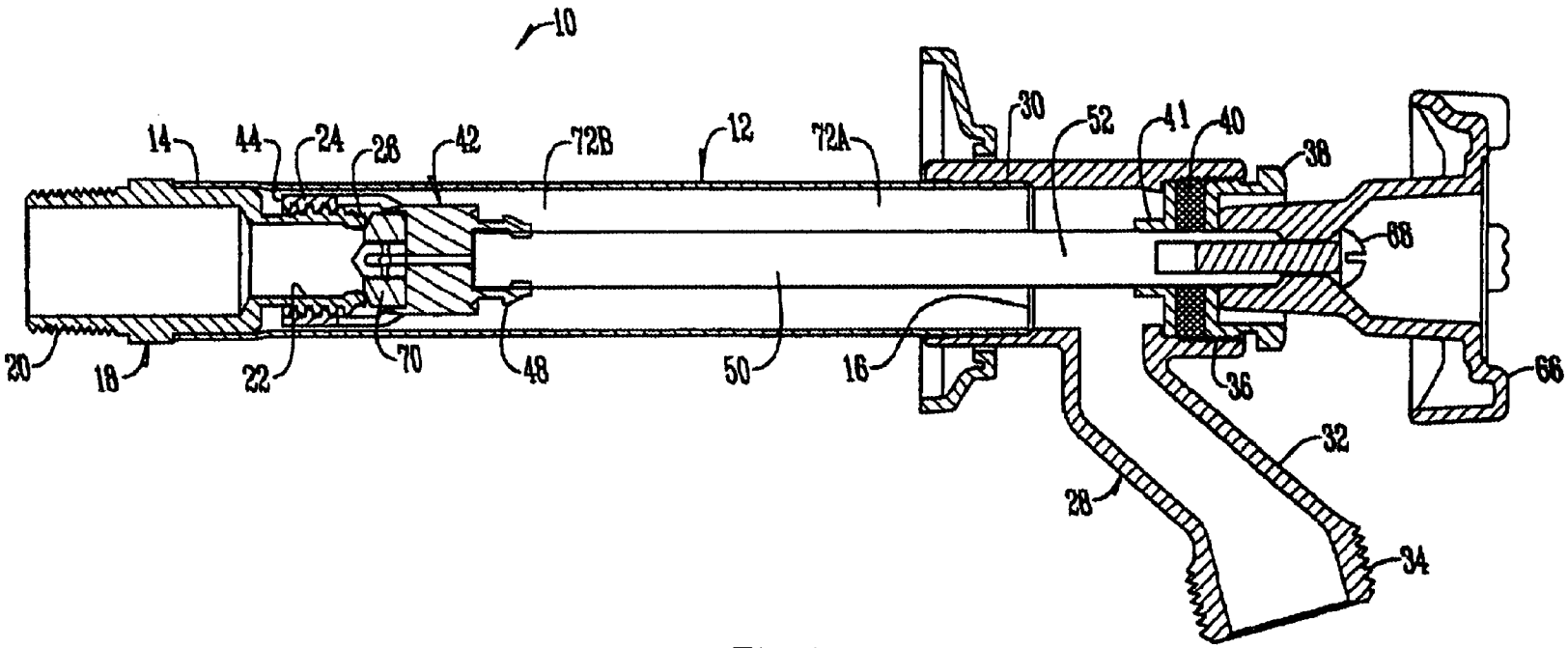
FIG. 1 is an elongated sectional view of a wall hydrant embodying the instant invention.

The hydrant 10 in FIG. 1 has an elongated hollow water inlet tube 12 which has an interior end 14 and an exterior end 16. A hollow valve fitting 18 is rearwardly secured to the interior end 14 of tube 12 and has a threaded end 20 adapted to be secured to a conduit connected to a source of pressurized fluid (not shown). The fitting 18 has an interior end 22 with external threads 24 and which terminates in a valve seat 26.

A casting member 28 with hollow interior end 30 is rigidly connected to the exterior end 16 of inlet tube 12. A conventional fluid drain conduit 32 is located within casting member 28 and is in communication with the interior of tube 12. Conventional threads 34 are located on the discharge end of conduit 32 to receive a conventional hose or the like. Casting member 28 also has a threaded aperture 36 which is adapted to receive a conventional bushing 38 which in turn receive packing 40 which is held in tight engagement with bushing 38 by packing washer 41 (FIG. 1).

With reference to FIG. 1, a valve body 42 has a bore at its inner end which engages the inner end 22 of hollow valve fitting 18. Valve body 42 has an outer end that is connected to the inner end of elongated rod 50 which extends along the center line of 212. The outer end 52 of rod 50 extends through bushing 38, packing 40, and packing washer 41 and is connected to operating handle wheel 66 by means of screw 68.

Figure 2:
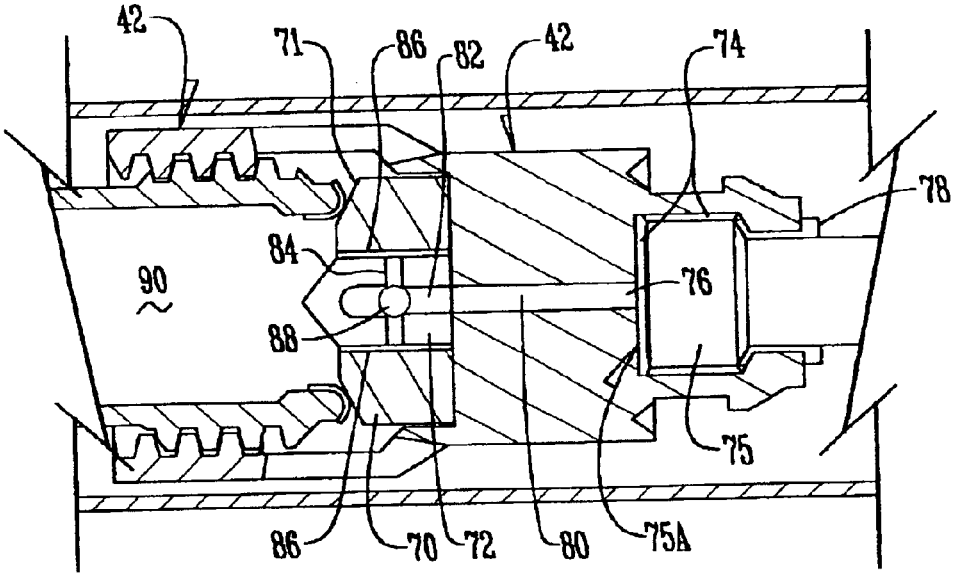
FIG. 2 is an enlarged scale sectional view taken on line 2—2 of FIG. 1.
Figure 3:
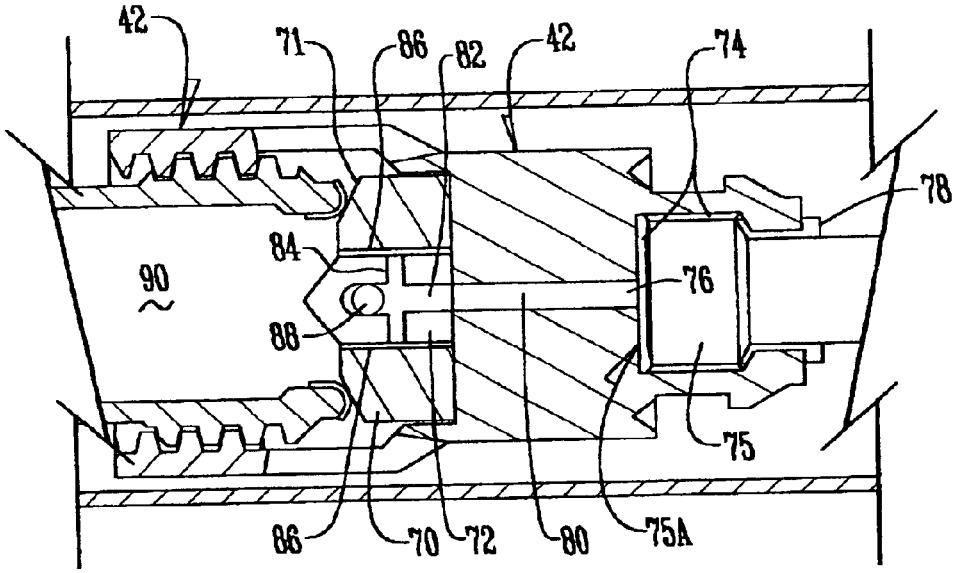
FIG. 3 is a sectional view similar to FIG. 2 but shows the valve element in an open condition.
Figure 4:
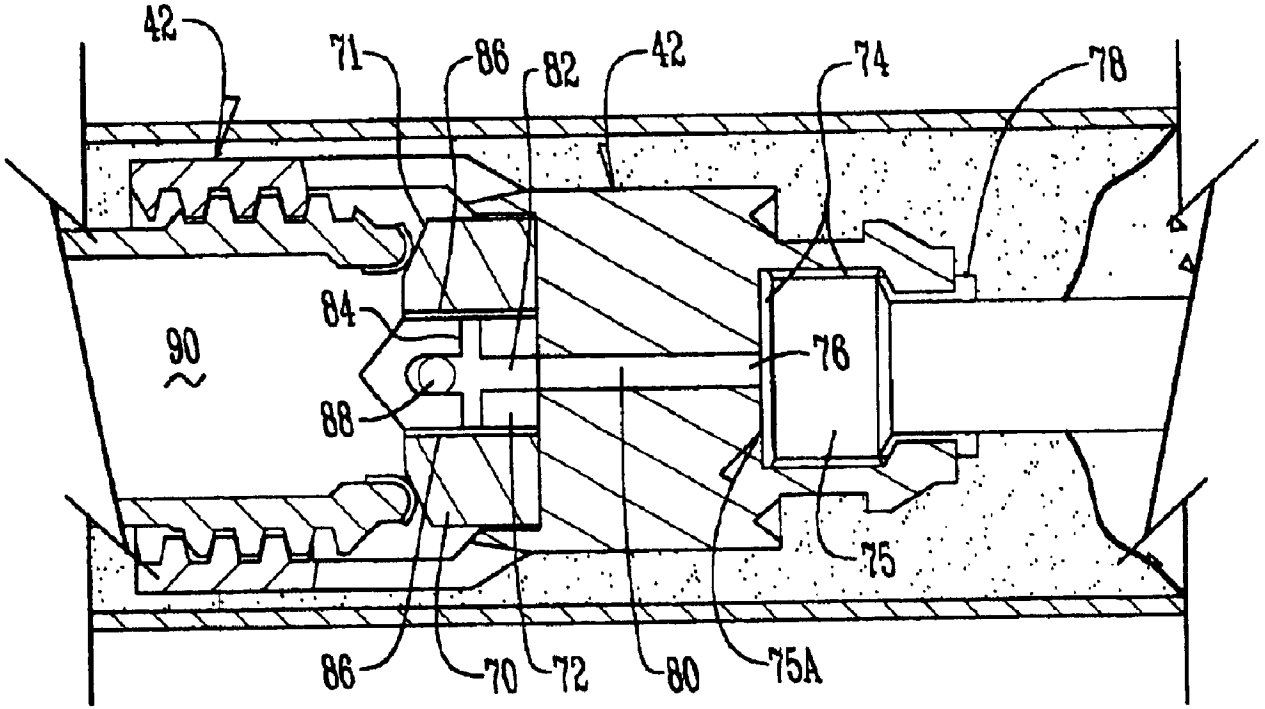
FIG. 4 is a sectional view similar to FIG. 3 with the valve element in an open condition, and with fluid and ice contained in the wall hydrant.

With reference to FIG. 2, a valve sealing element 70 with a seating surface 71 has a plug insert 72 mounted in the center thereof. An elongated fluid passageway 74 has an open inner end 76 and an opened outer end 78. The passageway 74 is created between the tolerances between the enlarged head 75 on the inner end of rod 50 and the socket 75A in which the head resides. (The head 75 is interconnected with the rod 50 by means of suitable splines on the head 75 and the socket 75A.) Center bore 80 extends along the center line of valve sealing element 70 and communicates and is in alignment with center bore 82. At least a pair of fluid exit conduits 84 extend radially outwardly from bore 82 and connect with fluid channel 86 which is comprised of the small clearance between plug insert 72 and valve seating element 70. A ball 88 is normally seated in center bore 80 at the intersection of fluid exit conduits 84 to prevent any fluid flow from bore 80 into the conduits 84 and thence into the thin fluid channel 86 which is in communication with the space 90 which contains potable water at less than 100 psi. With reference to FIGS. 2-4, when the water pressure in inlet tube 12 increases by reason of ice forming at the outer end thereof (FIG. 4), this increased fluid pressure will be translated through fluid passageway 74, center bore 80 in the valve sealing element 70, and thence into the center bore 82 in plug insert 72. This increased pressure will bear against ball 88 and force it into the position shown in FIGS. 3 and 4, whereupon fluid flow can be made through bore 80, bore 82, bores 84, conduit 86, and thence into the space 90 which contains lower pressure potable water. This activity reduces the higher pressure of the fluid in the inner end of inlet tube 12 and prevents the fluid pressure therein from exceeding the rupture pressure of the inlet conduit.

Typically, the removable of a teaspoon of residual water from the inner end of the inlet tube 12 will be sufficient to keep the rupturing pressure of the residual water from being reached.

It is therefore seen that this invention will achieve at least all of its stated objectives.

We claim:

1. A freezeless wall hydrant, comprising, a normally horizontal fluid inlet tube having an interior end and an exterior end, a hollow valve fitting rigidly secured to the interior end of the inlet tube for connection to a source of pressurized fluid, a valve seat on an interior end of the valve fitting, a casting member rigidly secured to the outer end of the inlet tube and including a drain conduit in communication with an interior of the inlet tube for discharging water from the hydrant, a valve body longitudinally movably mounted in the inlet tube adjacent the valve fitting, a valve seating element on the valve body adapted to engage and disengage the valve seat to prevent or permit, respectively, a fluid flow through fitting into the inlet tube, an elongated operating rod having a rearward end secured to the valve body and an outer end protruding from the casting member for longitudinally moving the valve body in the inlet tube, a plug insert fixedly mounted in the center of the valve seating element, an elongated first fluid passage in the valve body in communication with the interior of an inner end of the interior of the inlet tube, and having an open inner end and an open outer end, a secondary fluid passageway in the plug insert and having inner end in fluid communication with the fluid passageway in the valve body, a movable valve element in the secondary fluid passageway normally closing fluid flow between the interior of the inlet tube and the first fluid passageway in the valve body, whereby the movable valve element will open fluid flow between the interior of the inlet tube to the fluid passageway in the valve body and into the hollow valve fitting when fluid pressure in the interior of the inlet tube increases beyond the fluid pressure in the fluid passageway to move the valve element in the valve body to permit fluid flow therebetween.

2. The hydrant of claim 1 wherein the movable valve element is a ball separating the secondary fluid passageway from the final fluid passageway.

3. The hydrant of claim 1 wherein the movable valve element is a check valve between the secondary fluid passageway and the first fluid passageway.

* * * * *